United States Patent [19]

van de Kamp

[11] Patent Number: 4,834,439

[45] Date of Patent: May 30, 1989

[54] LOAD LIFTING SLING AND TEXTILE WEBBING FOR PRODUCING THE SLING

[75] Inventor: Dieter van de Kamp, Bad Pyrmont, Fed. Rep. of Germany

[73] Assignee: Spanset Inter AG, Oetwil am See, Switzerland

[21] Appl. No.: 123,255

[22] Filed: Nov. 20, 1987

[30] Foreign Application Priority Data

Nov. 22, 1986 [DE] Fed. Rep. of Germany ..... 8631339

[51] Int. Cl.[4] ..... B66C 1/18

[52] U.S. Cl. ..... 294/74; 428/43

[58] Field of Search ..... 294/74; 57/200, 260; 139/407, 420 R; 428/43

[56] References Cited

U.S. PATENT DOCUMENTS

| | | | |
|---|---|---|---|
| 3,563,839 | 2/1971 | Divis | 428/43 |
| 3,701,559 | 10/1972 | Marino et al. | 294/74 |
| 4,116,481 | 9/1978 | Raue | 294/74 |

FOREIGN PATENT DOCUMENTS

| | | | |
|---|---|---|---|
| 684407 | 7/1966 | Belgium . | |
| 7515053 | 10/1975 | Fed. Rep. of Germany . | |
| 2847563 | 5/1979 | Fed. Rep. of Germany | 294/74 |
| 2855974 | 7/1980 | Fed. Rep. of Germany | 294/74 |
| 932554 | 3/1948 | France . | |
| 65993 | 3/1956 | France . | |
| 1258862 | 3/1961 | France . | |
| 1396435 | 3/1965 | France . | |
| 2010776 | 7/1979 | United Kingdom . | |
| 1556818 | 11/1979 | United Kingdom | 294/74 |

*Primary Examiner*—Johnny D. Cherry

*Attorney, Agent, or Firm*—Spencer & Frank

[57] ABSTRACT

A strap for the production of load lifting slings equipped with lifting loops and tie loops arranged parallel thereto is composed of a webbing fabric. In a width region arranged at a distance from both side edges of the strap, in which a cut is to be made in the longitudinal direction of the webbing through the transverse bond, the warp yarns of the webbing fabric are formed of textile yarns (meltable yarns) of a synthetic material whose melting temperature is lower than the melting temperature of the warp yarns in at least the width region of the strap forming the lifting loop. The cut to produce the tie loop is made by a hot cut under the influence of heat in such a manner that only the meltable yarns melt.

13 Claims, 4 Drawing Sheets

LOAD LIFTING SLING AND TEXTILE WEBBING FOR PRODUCING THE SLING

BACKGROUND OF THE INVENTION

1. Field of the Invention

The invention relates to a load carrying lifting sling of the type formed of a high tensile strength strap or webbing composed of textile yarns which lie next to one another in approximately the same plane in the longitudinal direction of the webbing, which are held together in their juxtaposed position and which are made, in particular, of synthetic material, and with the lifting sling being provided with lifting loops for the attachment of a lifting device (8), and tie loops for fixing a load to be lifted, with each lifting loop lying next to a respective tie loop and being separated by division of the textile yarns into two parallel strands of webbing which are separated from one another by a slit extending in the longitudinal direction of the webbing. A load carrying lifting sling of this type is disclosed, for example in British Patent No. 1,556,818.

2. Discussion of the Prior Art Lifting slings of the above type, also sometimes called "cloverleaf" slings, are traditionally composed of a textile webbing. Such textile webbing can be woven in a practically unlimited length which is limited only by transporting possibilities. Lifting slings of different circumferential lengths are required for the respective uses. To produce such slings of textile webbing, the webbing is cut to the desired length from an available supply and the two ends of the piece of webbing are sewn together. Such a cloverleaf sling has been further developed by sewing on or otherwise attaching tie loops likewise composed of textile webbing material, as shown, for example, in DE-AS No. 2,256,452 which corresponds to U.S. Pat. No. 3,701,559.

Since the sewing of tie loops to lifting straps, which are likewise composed of textile webbing material, is very labor intensive, a lifting sling with tie loops as described above and disclosed in British Pat. No. 1,556,818 has been developed in which the load carrying means, instead of textile webbing, is a single or multi-layer skein of yarns, with the textile yarns forming a closed ring-shaped strap. The transverse connection of the threads in the skein is effected by an elastic, moisture resistant binder, namely a layer of plastic. The drawback of these lifting slings with tie loops, which can be produced with savings of labor and costs, is that, depending on the machinery employed by the manufacturer, they can be produced only to a limited circumferential length. Such lifting slings can also not be produced with any desired load carrying capability because the thickness of the plastic layer producing the transverse bond between the textile yarns is limited by the need to ensure a minumum degree of flexibility for the lifting sling. A further drawback of these lifting slings is also that the user can obtain them only in lengths determined by the manufacturer.

SUMMARY OF THE INVENTION

It is the object of the invention to provide a lifting sling of the above-mentioned type in which the possibility of easily producing tie loops, merely by partially cutting apart the transverse bond existing between the load-carrying textile yarns, can be maintained, while otherwise the disadvantageous transverse bond in the form of a plastic layer between the load carrying textile yarns is avoided.

The above object is achieved according to the present invention in that in a load carrying sling of the type initially described above: the strap is made of a woven webbing favric with the textile yarns extending in the longitudinal direction of the webbing being the warp yarns of the webbing fabric; in a certain cut width region of the webbing arranged at a distance from the two side edges of the webbing, the warp yarns of the webbing fabric are formed by textile yarns (meltable yarns) of a synthetic material whose melting temperature iss lower than the melting temperature of the warp yarns of at least the width region of the webbing adjacent the slit which forms the lifting loop; and each slit between a lifting loop and an adjacent tie loop is produced by a longitudinal cut made in the longitudinal direction of the webbing in the cut width region containing the low temperature melting point warp yarns under the influence of heat such that only the meltable warp yarns, melt and not the adjacent, higher temperature melting point warp yarns.

This solution makes it possible to produce the lifting slings of textile webbing in the traditional manner and to utilize their advantageous characteristics, but nevertheless to be able to subsequently attach the tie loops in an easy and labor saving manner according to individual requirements. To accomplish this, the invention employs the fabric structure disclosed in French Pat. No. 1,396,435 and in French Pat. No. 1,258,862 for use of the hot-cutting method employed in the longitudinal direction of the warp yarns.

According to a further feature of the invention, the woof yarn or yarns of the webbing fabric contain at least one textile yarn (meltable yarn) which is made of a synthetic naterial whose melting temperature is lower than the melting temperature of the remaining woof yarns or yarns. This prevents, with even greater reliability, the danger of the webbing fabric splitting open in the region where it is cut because the connection between the ends of the fabric is ensured between the low-melting-point fusible warp yarns in the region of the slit and the woof yarns, particularly in that part of the woof which melts at low temperatures.

BRIEF DESCRIPTION OF THE DRAWINGS

The subject matter of the invention will be described below in greater detail with reference to embodiments that are illustrated in the drawings figures wherein.

DESCRIPTION OF THE PREFERRED EMBODIMENTS

Figure 1:
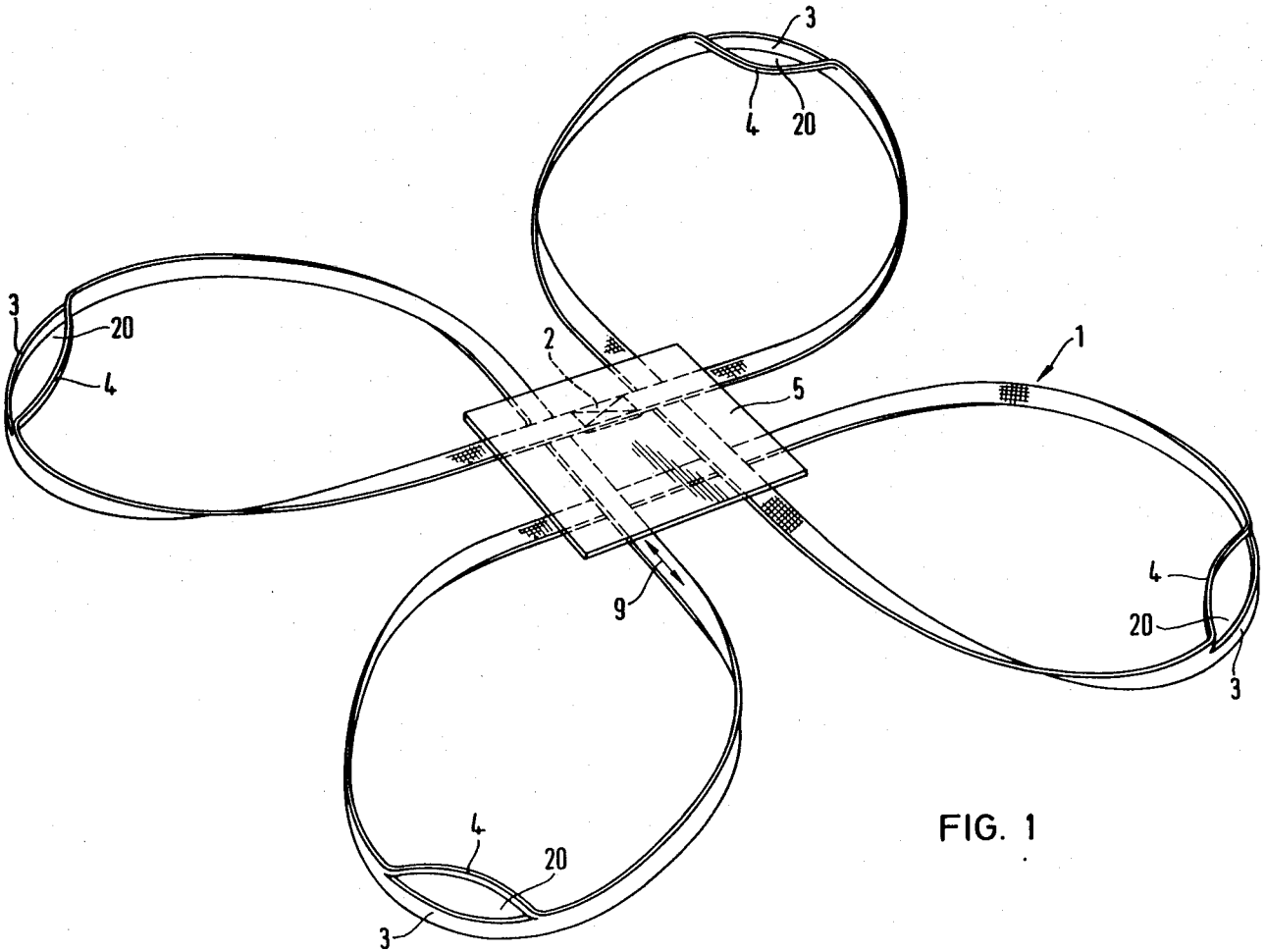
FIG. 1, illustrates a so-called cloverleaf sling in its laid-out state before it is fixed to the load.
Figure 3:
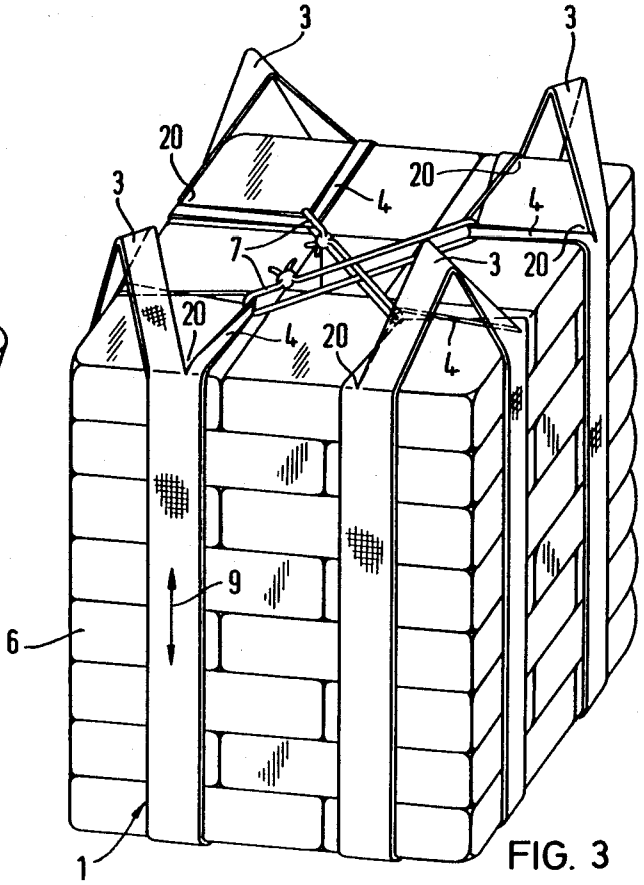
FIG. 3, illustrates a stacked load according to Fig. 2 in the set-down state, held togerher by a cloverleaf sling produced from the webbing according to the invention.
Figure 2:
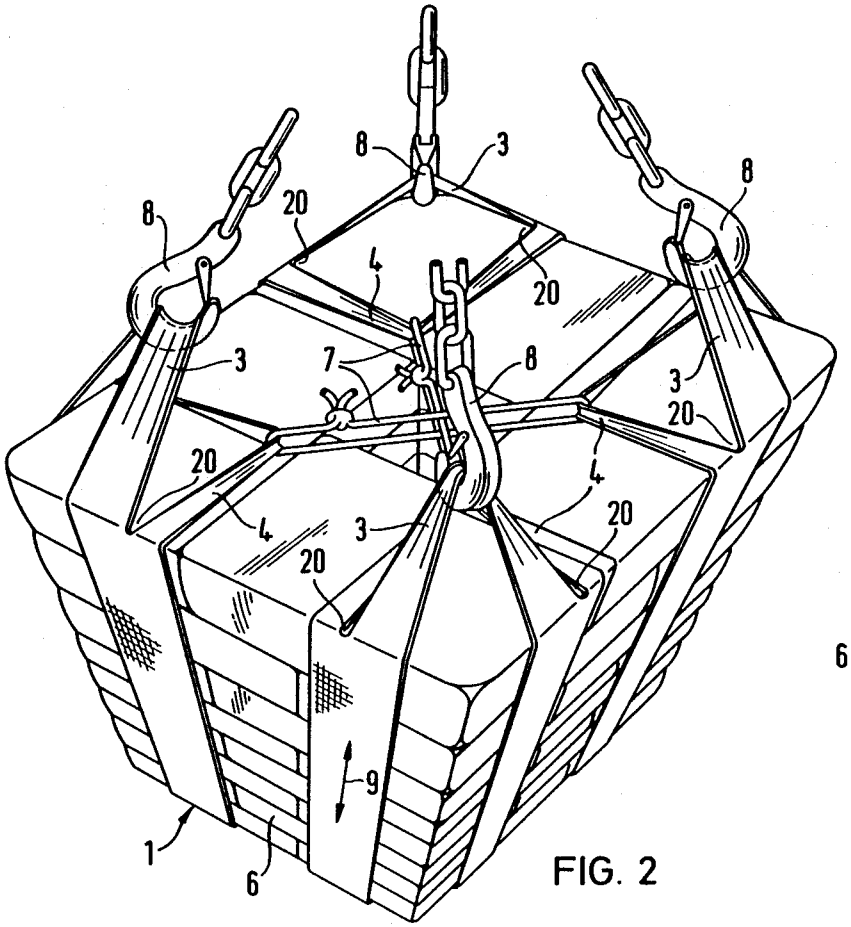
FIG. 2, is a perspective view of a lifting sling fixed around a stacked load and suspended from four crane hooks.
Figure 4:
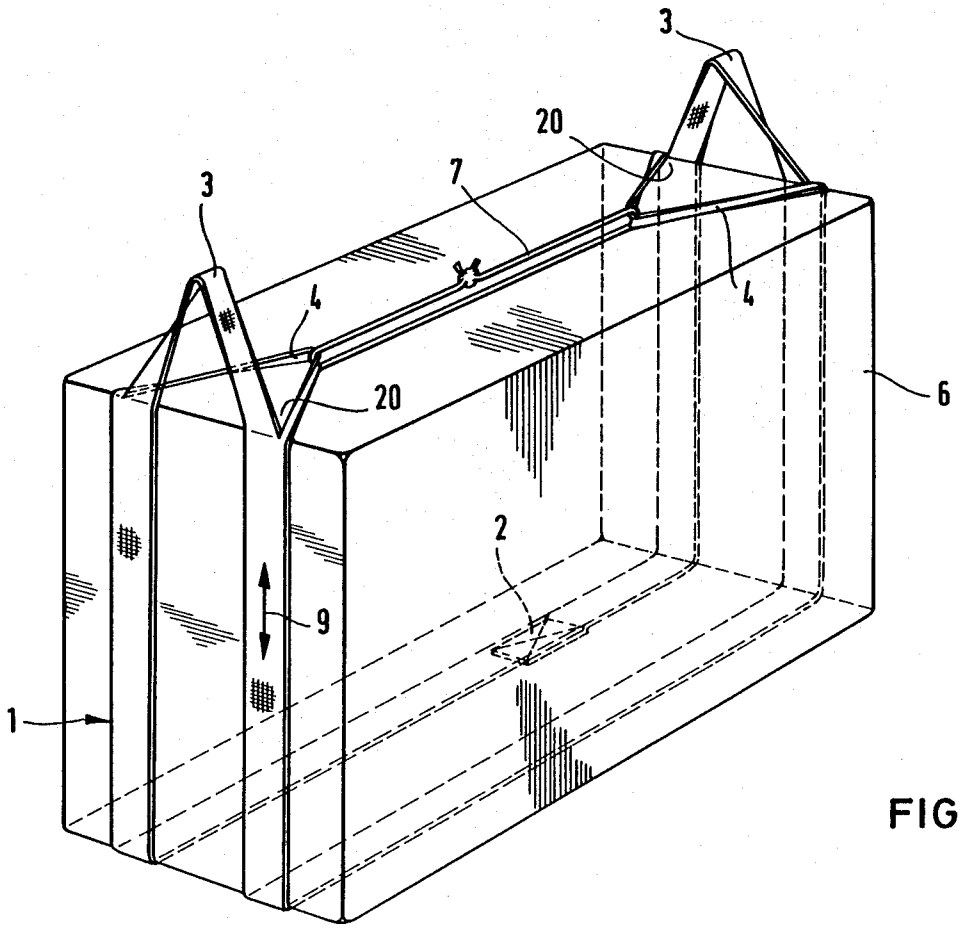
FIG. 4 is a schematic illustration of a stacked load held together by a lifting sling composed of two lifting loops and two tie loops.
Figure 5:
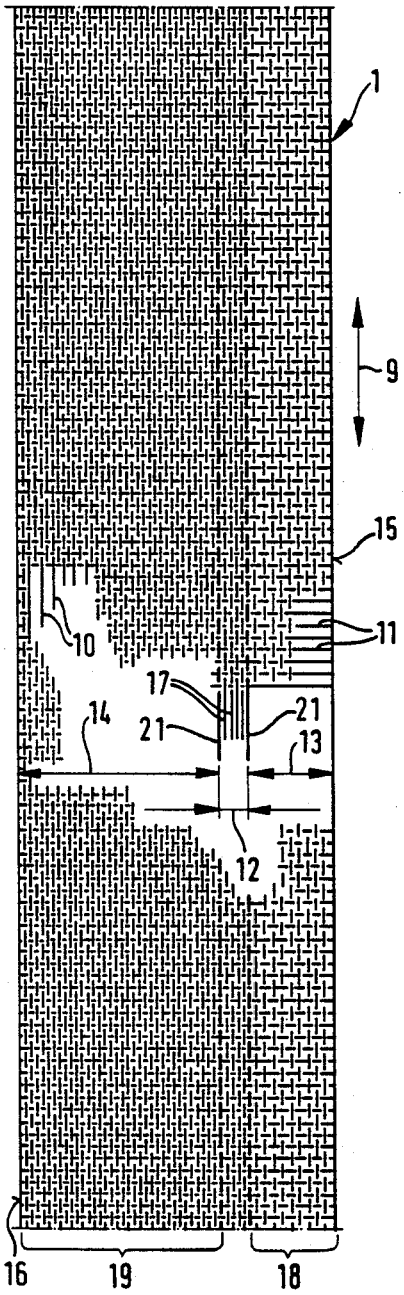
FIG. 5 illustrates the webbing configured according to the invention.
Figure 6:
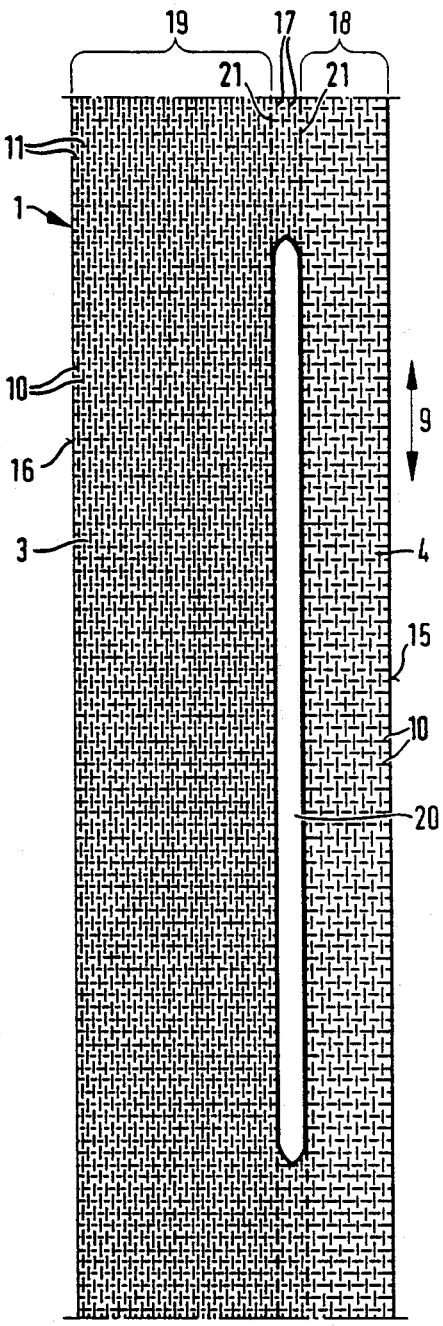
FIG. 6 illustrates the webbing according to Fig. 5 in the region of the cut-open slit.

The lifting slings according to Figs. 1 and 4 are produced essentially in that the strap 1 is cut in the respective circumferential length desired for the lifting sling from a supply of webbing of practically infinite length and the two ends of the cut strap are initially connected by means of a seam 2 to form a closed sling. Then, the sling is laid out in the form of a cloverleaf (Figs. 1 to 3) or in the form of an elongate oval (Fig. 4), before the tie loops 4 are attached in the region of the lifting loops 3 and perhaps also a load supporting bottom 5. When fixed to the load or to a stacked load 6, tie loops 4 are tied together —crossed over in the case of Figs. 2 and 3 —on the upper side of the stacked load 6 by a pulling means 7. Thus the stacked load 6 is held together even when set down (Figs. 3, 4) without the free access to lifting loops 3 for insertion of crane hooks 8 being interfered with.

Strap 1 is woven of warp yarns 10, 17 extending in the longitudinal direction 9 of the webbing and woof yarns 11 extending in the transverse direction of the webbing. A center strap or cut width region 12 extends to both sides at a distance 13 and 14 from the two side edges 15 and 16 of the webbing. In the longitudinal direction 9 of the webbing, this region extends over the entire length of the strap. In the cut width region 12, the warp yarns 17 of the webbing fabric are formed of textile yarns made of a synthetic material whose melting temperature is lower than the melting temperature of the warp yarns 10 forming the lateral strap width regions associated with distances 13 and 14. These textile yarns formed of comparatively low-temperature melting point plastic will hereinafter be simply called "meltable yarns". The width region associated with the larger distance 14 is the load-bearing region of the lifting sling made of the webbing, while the width region associated with the smaller distance 13 forms the tie loops 4. This width region associated with the shorter distance 13 therefore will be subjected to lower tensile stresses than must be absorbed by the load-carrying region of the future lifting strap. Therefore, the woven density of this region can be less than that of the load-carrying region (distance 14). In the width regions associated with distances 13 and 14, the warp yarns 10 are made of a plastic whose melting temperature, however, is significantly higher than the melting temperature of the meltable warp yarns 17 in cut width region 12.

To produce the tie loops 4, it is merely necessary to make a longitudinal cut in the longitudinal direction 9 of the strap, i.e. in the direction of the warp yarns, in the cut width region 12 equiped with the meltable warp yarns 17. This cut is made under the influence of heat in such a manner that only the meltable warp yarns 17 melt but not the warp yarns 10 lying in the two lateral width regions 18 and 19 whereby the respective desired slits or slot 20 is provided. facilitates the desired production of a substance-locking connection, while the comparatively higher temperature melting point textile yarns (warp yarns 10 and woof yarns 11) do not change their aggregate state under the influence of temperature and remain undamaged. Instead of a mechanical hot cutin the longitudinal direction 9 to sever woof yarns 11, such a cut may also be performed by means of radiation, ultrasound or blowers.

For example, the following materials are used for the textile yarns to produce the webbing according to the invention:

Example a:

For the supporting textile yarns having the comparatively high melting temperature, polyester (PES) yarns having a melting point of about 240° C. and for the comparatively low-melting-point textile yarns (meltable yarns) polypropylene having a melting point at about 170° C.

Example b:

For the supporting textile yarns having the comparatively high melting point, polypropylene yarns having a melting point of about 160° C. and yarns (meltable yarns) polyethylene having a melting point at about 125°C.

The webbing according to the invention may have, for example, the following composition:

material: PP-PE
color: unbleached white
foundation warp: 300 threads at dtex 1100 white PP
marking yarn: 1 thread at dtex 1100 red PP
marking yarn: 1 thread at dtex 1100 yellow PP
meltable yarn: 39 threads at dtex 0.20 monofilament
woof 1: 30/10 cm dtex 1100 white PP
woof 2: 30/10 cm dtex 0.20 PE monofilament
width: 55±1 mm
thickness: approximately 2.00 mm
weight: 46±1 g/m
min. breaking load: =1,500 daN In the production of lifting slings of the webbing according to the invention, the tie loops can also be produced simultaneously, after the loop configuration has been laid out, mechanically or automatically by cutting the slits 20.

The width of cut region 12 is delimited on both sides by at least one warp yarn 21 which differs in color from the webbing fabric so that, in the case of manual cutting of slits 20, damage, particularly to the load carrying strap width region 19, can be prevented and it can be ensured that the hot cut is made int the intended region.

What is clamed is:

1. In a load carrying lifting sling made of a high tensile strength strap composed of textile yarns which lie next to one another in approximately the same plane in the longitudinal direction of the strap, which are held together in their juxtaposed position, and which are made, in particular, of synthetic materials; and wherein said lifting sling is provided with lifting loops for attachment of a lifting device and tie loops for fixing the load to be lifted, with each lifting loop lying next to a respective tie loop and being separated from one another by division of the textile yarns into two parallel strands of strap by respective slit extending in the longitudinal direction of the strap; the improvement wherein:

(a) the strap is made of a webbing fabric and the textile yarns extending in the longitudinal direction of the strap are warp yarns of the webbing fabric;

(b) in a certain cut width region of the webbing arranged at a distance from the two side edges of the webbing, the warp yarns of the webbing fabric are formed by meltable textile yarns made of a synthetic material whose melting temperature is lower than the melting temperature of the warp yarns of at least the width region of the webbing which forms the lifting loop in the region of the slit; and (c) each slit between a lifting loop and a respective tie loop, is a longitudinal cut, made in the lingitudinal direction of the webbing, in a respective portion of said cut width region in which the low temperature melting point warp yarns have been removed by melting under the influence of heat.

2. A lifting sling according to claim 1, wherein said sling includes woof yarns extending transverse to the warp yarns and the woof yarns of the webbing fabric contain at least one meltable textile yarn which is made of a synthetic material whose melting temperature is lower than the melting temperature of the remaining woof yarns.

3. A lifting sling according to claim 1, wherein the meltable yarns of the webbing fabric are monofilaments.

4. A lifting sling according to claim 1, wherein polyester is employed as the higher temperature melting point material and polypropylene as the low temperature melting point material at least for the warp yarns of the webbing fabric.

5. A lifting sling according to claim 1, wherein polypropylene is employed as the higher temperature melting point material and polyethylene as the low temperature melting point material at least for the warp yarns of the webbing fabric.

6. A lifting sling according to claim 1, wherein the cut width region containing the warp yarns formed by the meltable yarns is delimited on both sides by at least one warp yarn which is of a distinctly different color from the webbing fabric.

7. A load carrying lifting sling comprising: a high tensile strength textile webbing of a synthetic material having a length in a longitudinal direction and a width in a transverse direction, and including a plurality of warp yarns arranged in the longitudinal direction of said webbing with the warp yarns disposed in a portion of the width of said webbing which is spaced from both respective side edges of said webbing being made of a material having a melting point which is lower than the melting point of the material of the remaonder of said warp yarns, and a plurality of woof yarns disposed in the transverse direction of said webbing and woven into said plurality of warp yarns; and means connecting the ends of the length of said webbing together; and a plurality of longitudinal slots formed in respective sections of said portion of the width of said webbing wherein said lower melting point warp yarns have been removed by melting to provide a respective plurality of lifting and tie loops for said sling.

8. A load carrying lifting sling as defined in claim 7, wherein at least one of said woof yarns is made of a material different than the remaining woof yarns such that said at least one woof yarn has a predetermined melting point which is less than the melting point of the material of the remaining woof yarns and of said warp yarns outside of said portion of said width.

9. A load carrying lifting sling as defined in claim 7, wherein each said lower melting point warp yarns are monofilaments.

10. A load carrying lifting sling as defined in claim 7, wherein said warp yarns in said portion of the width of said webbing are made of polypropylene and the remainder of said warp yarns are made of polyester.

11. A load carrying lifting sling as defined in claim 7, wherein said warp yarns in said portion of the width of said webbing are made of polyethylene, and the remainder of said warp yarns are made of polyproplene.

12. A load carrying lifting sling as defined in claim 7, wherein said portion of the width of said webbing is delimited on both sides by at least one warp yarn which is a different color from the rest of said webbing.

13. A method of making a load carrying lifting sling made of a high tensile strength, comprising the steps of:

providing a textile webbing of a synthetic material having a length in a longitudinal direction and a width in a transverse direction, and having:

a plurality of warp yarns arranged in the longitudinal direction of said webbing, with the warp yarns disposed in a portion of the width of said webbing which is spaced from both respective side edges of said webbing being made of a material having a melting point which is lower than the melting point of the material of the remainder of said warp yaarns, and a plurality of woof yarns disposed in the transverse direction of said webbing and woven into said plurality of warp yarns;

producing a plurality of slots in the longitudinal direction of said webbing in desired sections of said portion of the width of said webbing by a longitudinal cut while applying heat in a manner to melt only the warp yarns in said section of said portion of the width and not the adjacent higher temperature melting point yarns to form a plurality of lifting loops and a plurality of adjacent tie loops; and attaching the ends of the length of the webbing together to form the load carrying lifting sling.

* * * * *